US009125799B1

(12) United States Patent
Freeman

(10) Patent No.: US 9,125,799 B1
(45) Date of Patent: Sep. 8, 2015

(54) REMOTELY LOCATABLE PACIFIER APARATUS

(71) Applicant: Kerrie Rae Freeman, Kingsforn, MI (US)

(72) Inventor: Kerrie Rae Freeman, Kingsforn, MI (US)

( * ) Notice: Subject to any disclaimer, the term of this patent is extended or adjusted under 35 U.S.C. 154(b) by 142 days.

(21) Appl. No.: 14/047,138

(22) Filed: Oct. 7, 2013

(51) Int. Cl.
*G08B 5/22* (2006.01)
*A61J 17/00* (2006.01)

(52) U.S. Cl.
CPC ..... *A61J 17/00* (2013.01)

(58) Field of Classification Search
CPC .... G08B 21/02; G08B 21/0202; G08B 21/24; A61J 17/00; A61J 2017/002; A61J 2017/005; G08G 1/0005; G08G 1/20; G08G 1/305
See application file for complete search history.

(56) References Cited

U.S. PATENT DOCUMENTS

| | | | | |
|---|---|---|---|---|
| 6,066,161 | A | 5/2000 | Parella | |
| 6,366,202 | B1 | 4/2002 | Rosenthal | |
| 6,535,125 | B2 | 3/2003 | Trivett | |
| 2003/0141973 | A1 * | 7/2003 | Yeh et al. | 340/539.13 |
| 2004/0043349 | A1 * | 3/2004 | Liao | 433/29 |
| 2006/0202840 | A1 * | 9/2006 | Korbonski | 340/573.4 |
| 2009/0040053 | A1 * | 2/2009 | White | 340/573.4 |

* cited by examiner

*Primary Examiner* — Kerri McNally
*Assistant Examiner* — Renee Dorsey
(74) *Attorney, Agent, or Firm* — Williams Intellectual Property; Benjamin F. Williams

(57) ABSTRACT

A remotely locatable pacifier apparatus that includes a hand-held control unit disposed in wireless communication with a pacifier unit, said control unit having a plurality of control unit Light Emitting Diodes ("LEDs") disposed thereon, each of said control unit LEDs illuminable sequentially to signal a direction and proximity of the pacifier unit relative the control unit, whereby a user is able to locate the pacifier unit without causing an audible or visible signal from the pacifier unit.

4 Claims, 4 Drawing Sheets

REMOTELY LOCATABLE PACIFIER APARATUS

BACKGROUND OF THE INVENTION

Various types of remotely locatable pacifier apparatuses are known in the prior art. However, what is needed is a remotely locatable pacifier apparatus that includes a handheld control unit disposed in wireless communication with a pacifier unit, said control unit having a plurality of control unit Light Emitting Diodes ("LEDs") disposed thereon, each of said control unit LEDs illuminable sequentially to signal a direction and proximity of the pacifier unit relative the control unit, whereby a user is able to locate the pacifier unit without causing an audible or visible signal respectively illuminated or sounded from the pacifier unit.

FIELD OF THE INVENTION

The present invention relates to a remotely locatable pacifier apparatus, and more particularly, to a remotely locatable pacifier apparatus that includes a handheld control unit disposed in wireless communication with a pacifier unit, said control unit having a plurality of control unit Light Emitting Diodes ("LEDs") disposed thereon, each of said control unit LEDs illuminable sequentially to signal a direction and proximity of the pacifier unit relative the control unit, whereby a user is able to locate the pacifier unit without causing an audible or visible signal respectively illuminated or sounded from the pacifier unit.

SUMMARY OF THE INVENTION

The general purpose of the remotely locatable pacifier apparatus, described subsequently in greater detail, is to provide a remotely locatable pacifier apparatus which has many novel features that result in a remotely locatable pacifier apparatus which is not anticipated, rendered obvious, suggested, or even implied by prior art, either alone or in combination thereof.

The present remotely locatable pacifier apparatus has been devised to enable expedient location of a misplaced pacifier unit when a handheld control unit is activated to sound an audible alarm from the pacifier unit, initiate a visible signal from the pacifier unit, or enable directional location of the pacifier unit by illumination of a plurality of control unit Light Emitting Diodes ("LEDs") disposed upon the control unit, each of said plurality of control unit LEDs disposed along a respective radii of the control unit whereby the direction of the pacifier unit is discernible relative the control unit.

The pacifier unit is thus disposed in wireless communication with the handheld control unit. The handheld control unit includes a top surface upon which a first button, a second button, and a third button are disposed. Depression of the first button initiates the visible signal from the pacifier unit, depression of the second button activates an audible signal from the pacifier unit, and depression of the third button enables directional discovery of the pacifier unit by illumination of the plurality of control unit LEDs disposed upon the top surface, whereby proximity and the relative direction of the pacifier unit is displayable by illumination of respective control unit LEDs, as will be subsequently described.

The handheld control unit includes a control unit transceiver disposed in wireless communication with a pacifier unit transceiver disposed in the pacifier unit. The pacifier unit includes a rubberlike or polymeric nipple disposed perpendicularly from a circular surface, said nipple disposed for suckling by an infant. The circular surface is disposed endwise upon a module unit. The module unit includes the pacifier unit transceiver, a battery compartment, and a speaker.

The speaker is wired in circuit with the battery compartment and the pacifier unit transceiver. When the first button is depressed upon the handheld control unit, the control unit transceiver initiates a wireless communication with the pacifier unit transceiver whereby the speaker is caused to activate and issue an audible tone. Thus the audible signal is activated when the first button is depressed.

A ring member is disposed endwise upon the module unit, opposite the circular surface. The ring member enables grasping by a parent or other user for presentation or removal of the nipple from a suckling infant. A plurality of pacifier unit LEDs is disposed upon the ring member. Each of the plurality of LEDs is wired in circuit with the battery compartment and the pacifier unit transceiver. When activated by depression of the control unit second button, each of the plurality of pacifier unit LEDs is illuminable whereby the visible signal is initiated.

Depression of the third button upon the control unit enables wireless communication between the control unit and the pacifier unit whereby the position of the pacifier unit relative the control unit is sensible. The plurality of control unit LEDs are disposed along radii upon the top surface of the control unit whereby a direction is indicatively discernible. Turning the handheld control unit in the direction of the pacifier unit causes at least one of the plurality of control unit LEDs situated most proximal the pacifier unit to illuminate. Travel in the indicated direction of the pacifier unit, therefore, is signaled by illumination of corresponding ones of the plurality of control unit LEDs. Further visual cues may be illumined by the plurality of control unit LEDs, such as flashing or color change, for example, to signal the relative proximity and direction of the pacifier unit relative a user wielding the handheld control unit.

A user may, therefore, cause location of a misplaced pacifier unit audibly, visibly, or directionally, as desired, whereby the issuance of an audible tone from the pacifier unit is avoidable, when desired, such as when an infant is sleeping.

Thus has been broadly outlined the more important features of the present remotely locatable pacifier apparatus so that the detailed description thereof that follows may be better understood and in order that the present contribution to the art may be better appreciated.

Objects of the present remotely locatable pacifier apparatus, along with various novel features that characterize the invention are particularly pointed out in the claims forming a part of this disclosure. For better understanding of the remotely locatable pacifier apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
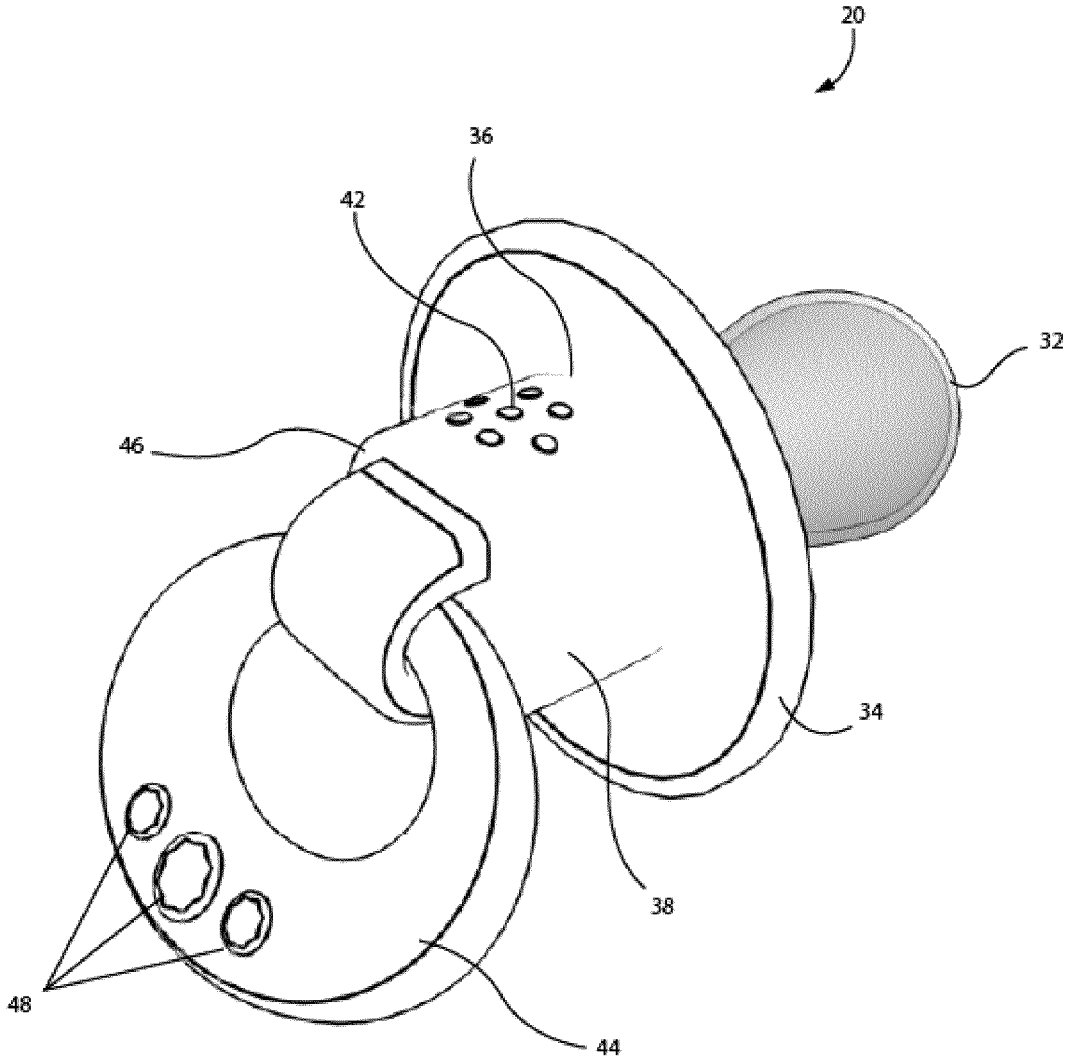
FIG. 1 is an isometric view of a pacifier unit.
Figure 2:
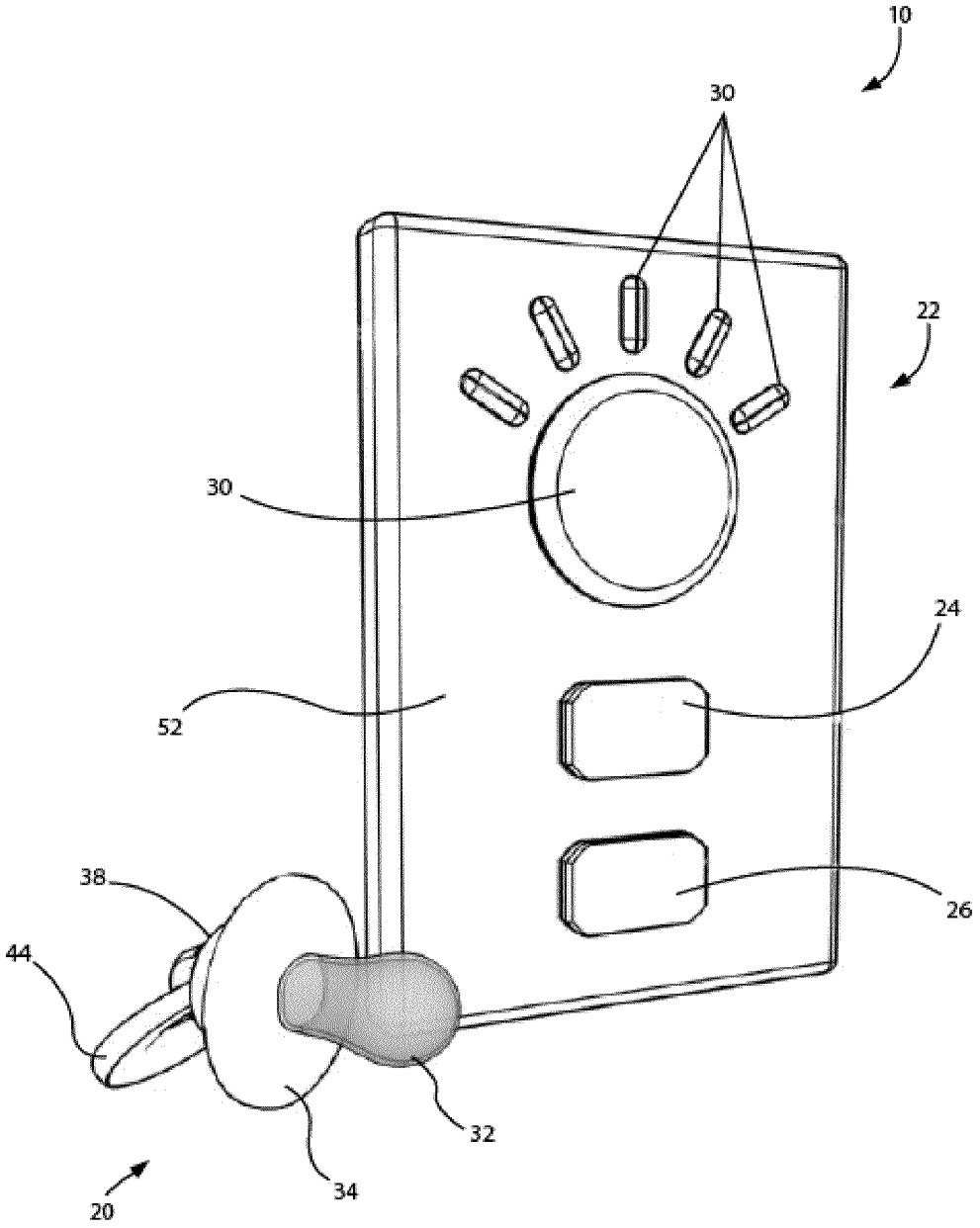
FIG. 2 is an isometric view of a pacifier unit and a handheld control unit.
Figure 3:
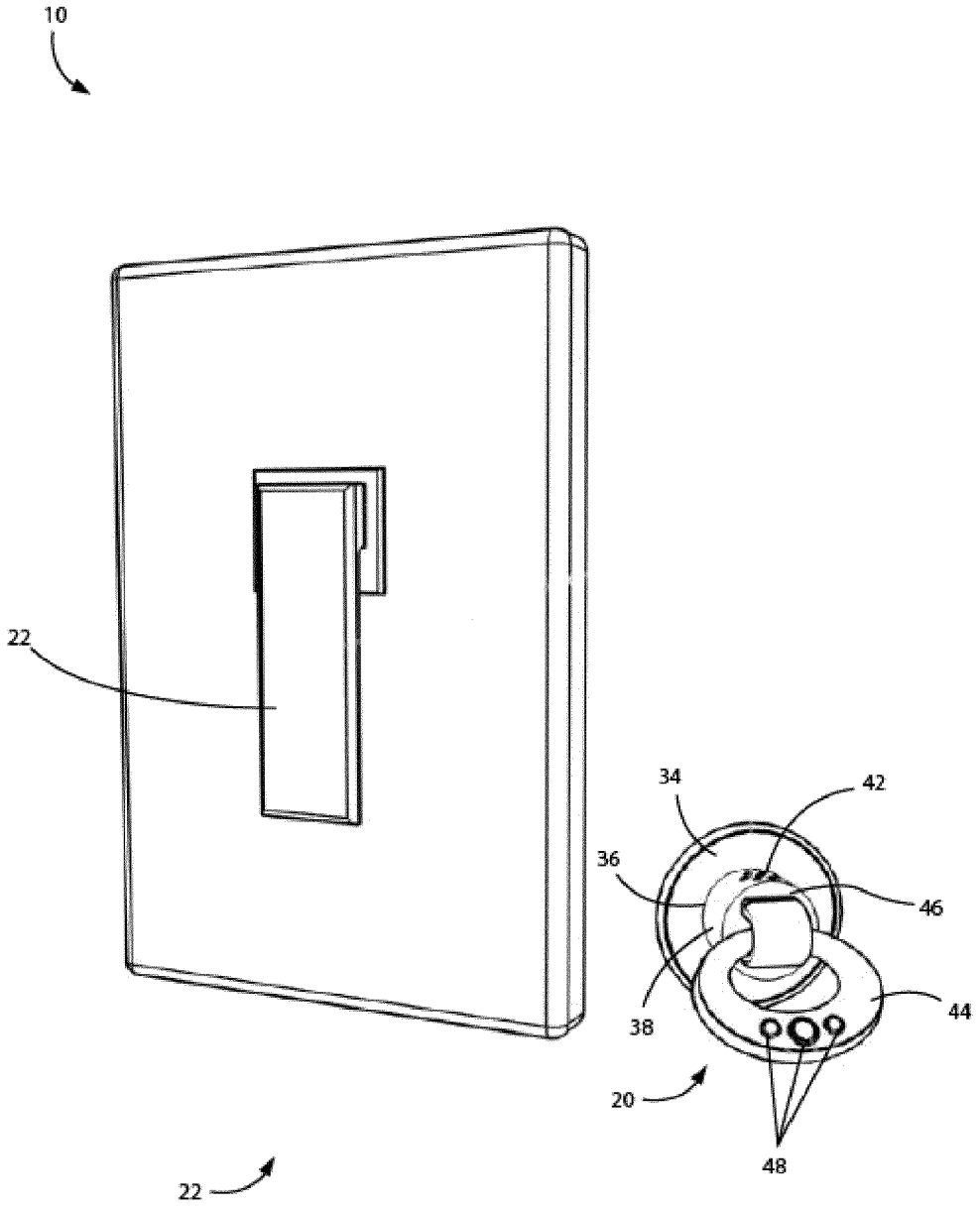
FIG. 3 is a rearward view of the pacifier unit and the control unit.
Figure 4:
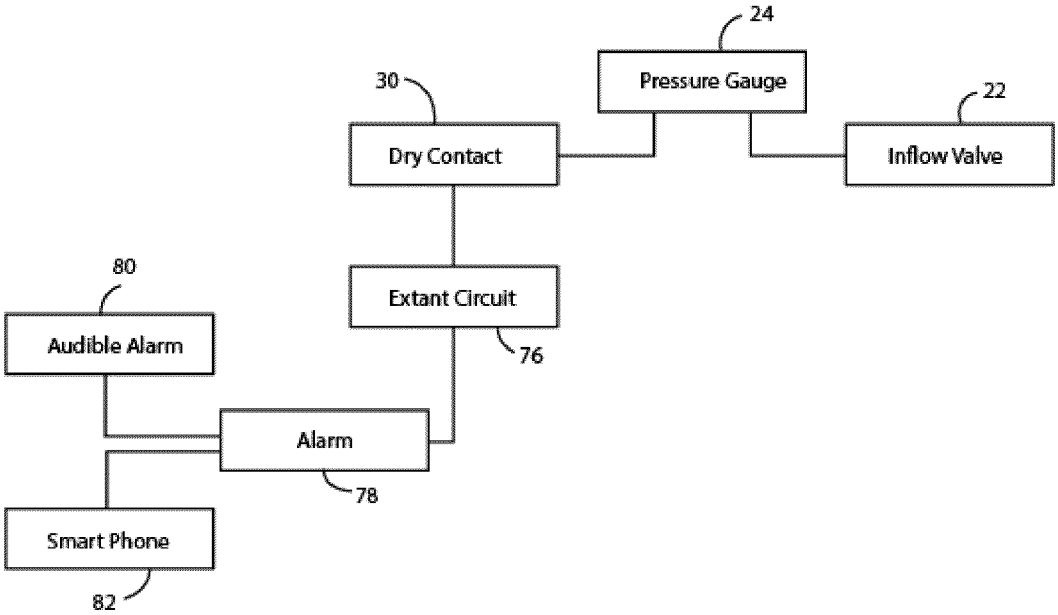
FIG. 4 is a block diagram view.

With reference now to the drawings, and in particular FIGS. 1 through 4 thereof, example of the instant remotely locatable pacifier apparatus employing the principles and concepts of the present remotely locatable pacifier apparatus and generally designated by the reference number 10 will be described.

Referring to FIGS. 1 through 4 a preferred embodiment of the present remotely locatable pacifier apparatus 10 is illustrated.

The present remotely locatable pacifier apparatus 10 has been devised to enable ready and expedient location of a misplaced pacifier unit 20 by use of a handheld control unit 22 disposed in wireless communication with the pacifier unit 20. The pacifier unit 20 is locatable by issuance of a visible alarm signal, an audible alarm signal, or by directional indication illuminable on the handheld control unit 22 when each of a respective first button 24, second button 26, and third button 28, disposed upon the control unit 22, is depressed.

A plurality of control unit Light Emitting Diodes ("LEDs") 30 is disposed upon the control unit 22, each of said plurality of control unit LEDs 30 disposed along radii upon the control unit 22 indicative of a direction relative the position of the handheld control unit 22. Depression of the third button 28 disposed upon the handheld control unit 22 illumines each of the plurality of control unit LEDs 30 to signify which direction relative the control unit 22*a* user may find the pacifier unit 20. The plurality of control unit LEDs 30 is selectively illuminable, and may flash intermittently and at increased frequency, or change color, or otherwise visibly signal the proximity of the user to the pacifier unit 20.

The remotely locatable pacifier apparatus 10, therefore, includes a handheld control unit 22 disposed in wireless communication with a pacifier unit 20. The pacifier unit 20 includes a polymeric nipple 32 for suckling by an infant. The polymeric nipple 32 is disposed perpendicularly upon a circular surface 34 disposed to gird around an infant's mouth, to prevent swallowing the nipple 32 or choking upon the nipple 32, and to provide a surface against which to suckle.

The circular surface 34 is disposed at a first end 36 of a module unit 38. The module unit 38 includes a battery compartment 40 and a speaker 42. The speaker 42 issues an audible alarm when activated by depression of the second button 26 disposed upon the handheld control unit 22.

A ring member 44 is disposed endwise at a second end 46 of the module unit 38, said ring member 44 usable to insert or remove the pacifier unit 20 from a suckling infant. The ring member 44 includes a plurality of pacifier unit LEDs 48 disposed thereupon, each of said pacifier unit LEDs 48 disposed in circuit with the battery compartment 40. Each of the plurality of pacifier unit LEDs 48 disposed upon the ring member 44 is illuminable when the first button 24 is depressed to initiate a visible signal to a user searching for the pacifier unit 20. A pacifier unit transceiver 50 is disposed within the module unit 38 whereby wireless transmissions are effective between the pacifier unit 20 and the handheld control unit 22.

The handheld control unit 22 is disposed in wireless communication with the pacifier unit 20. The handheld control unit 22 includes a top surface 52 upon which the first button 24 is disposed, said first button 24 depressible thereat to illuminate the plurality of pacifier unit LEDs 48 disposed upon the ring member 44 to cue the visible signal for a person searching for the pacifier unit 20.

The second button 26 is disposed upon the top surface 52 of the control unit 22, said second button 26 thereat depressible to signal an audible tone from the speaker 42 disposed upon the pacifier unit 20 whereby an audible signal is producible to assist a user in finding the pacifier unit 20 when misplaced.

The third button 28 is disposed upon the top surface 52 of the control unit 22, said third button 28 thereat depressible to initiate location of the pacifier unit 20 by selective illumination of the plurality of control unit LEDs 30 disposed upon the control unit 22. Each of the plurality of control unit LEDs 30 is situated along radii of the top surface 52 whereby illumination of each of said plurality of control unit LEDs 30 is indicative of a direction relative the handheld control unit 22. Each of the plurality of control unit LEDs 30 may be disposed to illuminate different colors and at flash at different intermittent speeds indicative of proximity and the relative direction of the pacifier unit 20 relative the control unit 22. More than one of the plurality of control u it LEDs may illuminate at a time to signal the correct direction of the pacifier unit 20 relative the control unit 22.

A control unit transceiver 54, disposed interiorly within the handheld control unit 22, is disposed in wireless communication with the pacifier unit transceiver 50. Depression of the third button 28 issues a wireless signal from the control unit 22 to the pacifier unit 20 and wireless communication between the control unit 22 and the pacifier unit 20 thereby enables directional locating of the pacifier unit 20 relative the control unit 22 by selective illumination of each of the plurality of control unit LEDs 30 disposed upon the control unit 22 top surface 52, whereby the proximity and relative direction of the pacifier unit 20 is effectively signaled to a user manipulating the control unit 22.

Thus a user may use the first button 24 to initiate a visual signal from the pacifier unit 20, and thereby potentially spot the pacifier unit 20 without causing an audible alarm. The user may also initiate an audible signal by depression of the second button 26, whereby location of the pacifier unit 20 may be assisted audibly. A user may use the third button 28 to initiate the illumination of the plurality of control unit LEDs 30 and thereby directionally locate the pacifier unit 20 by following the directional illumination of each of the control unit LEDs 30 caused to illuminate when most proximal the pacifier unit 20.

In the preferred embodiment herein disclosed, a clip member 56 is disposed upon the control unit 22 for selective attachment of the control unit 22 to a surface or upon a person, as desired.

What is claimed is:

1. A remotely locatable pacifier apparatus comprising:

a pacifier unit comprising:

a polymeric nipple for suckling, said nipple disposed perpendicularly from a circular surface disposed at a first end of a module unit;

a speaker disposed upon the module unit;

a battery compartment disposed within the module unit, said battery compartment wired in circuit with the speaker;

a ring member disposed endwise at a second end of the module unit;

a plurality of LEDs disposed upon the ring, each of said LEDs disposed in circuit with the battery compartment;

a pacifier unit transceiver disposed within the module unit;

a handheld control unit disposed in wireless communication with the pacifier unit and usable to issue each of a visual and an audible alarm signal from the pacifier unit, said handheld control unit comprising:

a first button depressible to issue the visual alarm from the pacifier unit;

a second button depressible to issue the audible alarm from the pacifier unit; and a third button depressible to signal directional proximity to the pacifier unit by effecting illumination of each of a plurality of LEDs disposed upon the top surface each of said plurality of LEDs illuminable to indicate a relative direction and proximity to the pacifier unit;

wherein each of the plurality of LEDs disposed upon the ring are illuminable when the first button is depressed upon the control unit and the speaker signals an audible signal when the second button is depressed upon the control unit.

2. The remotely locatable pacifier apparatus of claim 1 wherein the handheld control unit further comprises:

a control unit transceiver disposed interiorly within the handheld control unit, said transceiver disposed in wireless communication with the transceiver disposed within the pacifier unit.

3. The remotely locatable pacifier apparatus of claim 2 wherein the plurality of LEDs is disposed upon a top surface of the control unit, each of said plurality of LEDs situated along radii of the top surface whereby illumination of each of said plurality of LEDs is indicative of a direction relative the handheld control unit.

4. A remotely locatable pacifier apparatus comprising:

a pacifier unit comprising:

a polymeric nipple for suckling, said nipple disposed perpendicularly from a circular surface disposed at a first end of a module unit;

a speaker disposed upon the module unit;

a battery compartment disposed within the module unit, said battery compartment wired in circuit with the speaker;

a ring member disposed endwise at a second end of the module unit;

a plurality of LEDs disposed upon the ring, each of said LEDs disposed in circuit with the battery compartment;

a pacifier unit transceiver disposed within the module unit;

a handheld control unit disposed in wireless communication with the pacifier unit, said handheld control unit comprising:

a top surface;

a first button disposed upon the top surface depressible to illuminate the plurality of LEDs disposed upon the pacifier unit;

a second button disposed upon the top surface depressible to signal an audible tone from the pacifier unit;

a third button disposed upon the top surface depressible to initiate location of the pacifier unit;

a plurality of LEDs disposed upon the top surface, each of said plurality of LEDs situated along radii of the top surface whereby illumination of each of said plurality of LEDs is indicative of a direction relative the handheld control unit; and a control unit transceiver disposed interiorly within the handheld control unit, said control unit transceiver disposed in wireless communication with the pacifier unit transceiver disposed within the pacifier unit;

wherein depression of the third button issues a wireless signal from the control unit and wireless communication between the control unit and the pacifier unit enables directional locating of the pacifier unit relative the control unit by illumination of each of the plurality of control unit LEDs disposed upon the control unit top surface whereby the proximity and relative direction of the pacifier unit is signaled to a user manipulating the control unit.

* * * * *